US006923240B2

(12) United States Patent
Tosco

(10) Patent No.: US 6,923,240 B2
(45) Date of Patent: Aug. 2, 2005

(54) PROCESS AND APPARATUS FOR PRODUCING CASTING CORES

(75) Inventor: Bartolomeo Tosco, Almese (IT)

(73) Assignee: Fata Aluminium S.p.A., Rivoli (IT)

( * ) Notice: Subject to any disclaimer, the term of this patent is extended or adjusted under 35 U.S.C. 154(b) by 0 days.

(21) Appl. No.: 10/799,289

(22) Filed: Mar. 12, 2004

(65) Prior Publication Data

US 2004/0177941 A1 Sep. 16, 2004

(30) Foreign Application Priority Data

Mar. 14, 2003 (EP) ..... 03425161

(51) Int. Cl.[7] ..... B22C 9/12

(52) U.S. Cl. ..... 164/12; 164/15; 164/16; 164/160.1; 164/226; 164/228; 164/234

(58) Field of Search ..... 164/120, 226, 164/228, 15, 16, 234, 160.1, 12

(56) References Cited

U.S. PATENT DOCUMENTS 4,226,277 A * 10/1980 Matalon ..... 164/7.1
4,832,108 A * 5/1989 Nagarwalla et al. ..... 164/180
5,368,087 A 11/1994 Rinz et al. ..... 164/228
5,837,373 A 11/1998 Siak et al. ..... 428/404
6,505,671 B1 * 1/2003 McKibben et al. ..... 164/12
6,520,244 B2 * 2/2003 Lapeus et al. ..... 164/228

FOREIGN PATENT DOCUMENTS

| | | |
|---|---|---|
| DE | 4112701 A1 | 10/1992 |
| EP | 0 608 926 A1 | 8/1994 |
| FR | 1247931 | 10/1960 |

* cited by examiner

*Primary Examiner*—Kevin Kerns
*Assistant Examiner*—I.-H. Lin
(74) *Attorney, Agent, or Firm*—Seed IP Law Group PLLC

(57) ABSTRACT

A method for producing sand cores for foundry, comprising the operations of: defining a molding cavity; blowing in a mixture of sand and hydrated binder into said molding cavity so as to produce a mass of sand, which reproduces in a complementary way the shape of said molding cavity; and producing the passage, through said mass of sand, of a flow of aeriform along at least one principal direction. The method comprises the operation of generating through said mass of sand a flow of aeriform, directed at least in part in a radial direction with respect to said principal direction.

18 Claims, 2 Drawing Sheets

PROCESS AND APPARATUS FOR PRODUCING CASTING CORES

FIELD OF THE INVENTION

Figure 1:
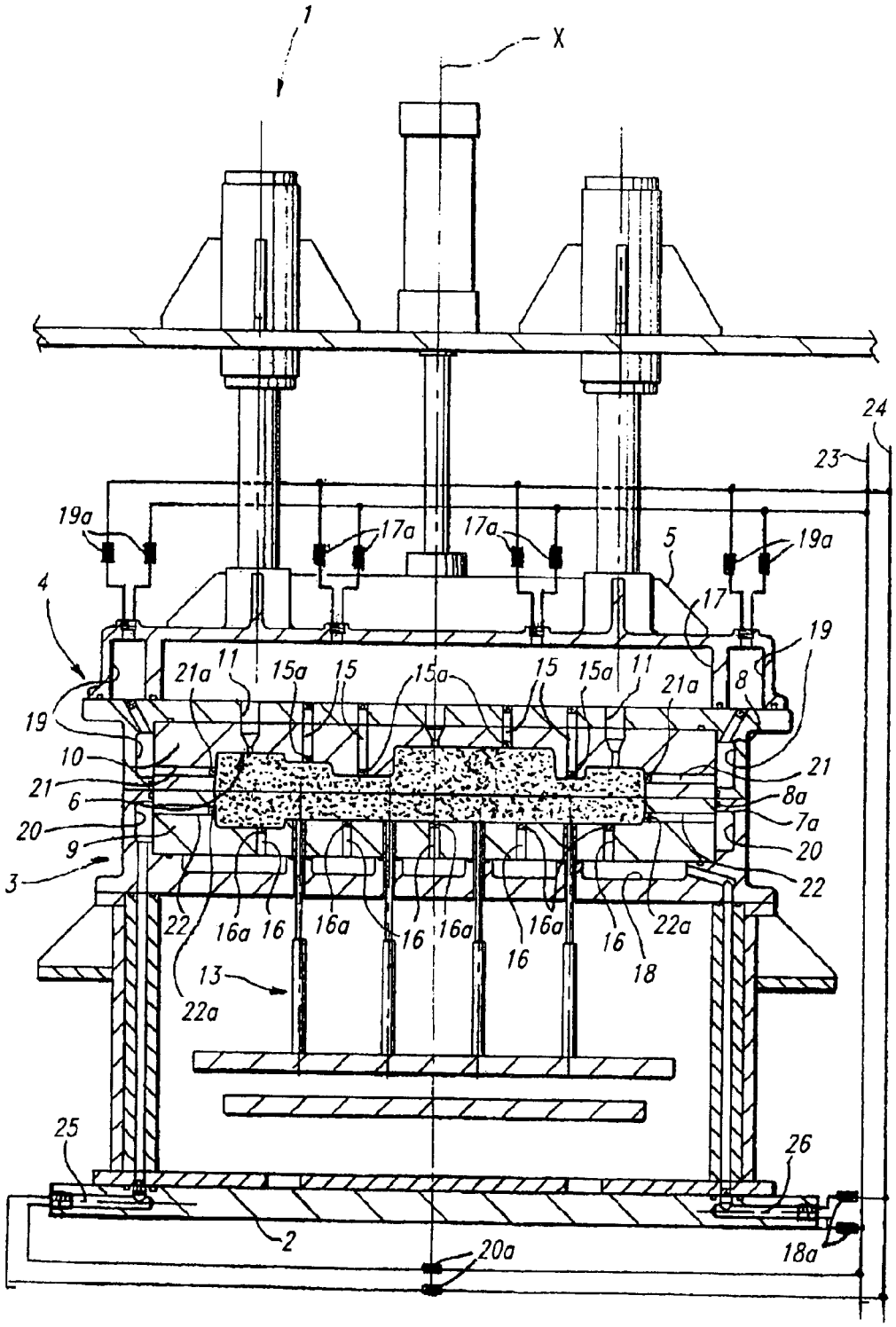

The present invention relates to the fabrication of cores for foundry.

BACKGROUND OF THE INVENTION

Cores of the type made and used according to the invention are substantially represented by shaped bodies made of sand held together by a binder capable of bestowing on the core the characteristics of solidity necessary for its correct use.

In the present description, as likewise in the ensuing claims, the term "sand" is used with the meaning commonly attributed to such a term in foundry techniques, i.e., to indicate sand of any type and nature, as well as particulate materials equivalent to sand, hence with the exclusion of materials of finer grain size, commonly referred to as "powder".

The term "binder" is understood as indicating any substance that can hold together, according to any physico-chemical mechanism, the grains of sand so as to ensure the necessary solidity of the core.

In the fabrication of said cores, it is common to resort to the solution which envisages blowing a flow of sand with associated thereto the binder or a precursor thereof inside a mould (i.e., core blowing). Once the mould has been filled, the mass of sand thus obtained is consolidated by activating, or else completing, the mechanism of intervention of the binder.

The above operation may involve heating the mass of sand that is in the mould—in the case of binders the mechanism of action of which is linked to heating—or else blowing in a catalyst or reagent (for example, an amine), which is designed to promote the intervention of the binder.

In more recent times, there has been proposed (see, for example, EP-B1-608926) a technique that envisages the use, as binder, of a protein, which is mixed to the sand in "hydrated" form, i.e., with the addition of water or equivalent humidifying agent.

The mechanism of intervention of said binder is hence linked to the possibility of removing the humidity present in the mixture of sand and protein blown into the mould. This result is normally obtained by passing a flow of hot and de-humidified aeriform through the mass of sand that is in the mould.

The techniques of fabrication of cores for foundry usually require the execution of other additional steps, which, however, are well known in the art and thus not described herein and not of specific importance for the purposes of the present invention.

In the solutions according to the known art, it is envisaged that the moulds (which are usually two, that are complementary to one another) that jointly define the moulding cavity of the core will be provided with ducts designed to function, respectively, as delivery ducts and extraction ducts of the aforesaid flow of aeriform.

Usually, said ducts present, in an area corresponding to their end facing the surface of the mould of the core, a gauze or filter designed to prevent, before the definitive consolidation of the core, the sand that composes it from accidentally penetrating the respective duct.

Broadly speaking, in the solutions according to the known art, the aforesaid ducts or channels for flow of aeriform are made in the (half) moulds so as to give rise to a flow of aeriform designed to traverse the sand core being formed in the mould cavity along a single principal direction.

This may be a vertical direction, in the case where the two half-moulds are superimposed on top of one another (according to the solution of use prevalent in the prior art), or else a horizontal direction (in the case where the two half-moulds are arranged alongside one another, according to another solution used in the known art).

The experience of use of said known solutions show, however, that these may be further improved in the areas of the possibility of speeding up the process of consolidation of the core entrusted to the flow of aeriform, also rendering more homogeneous the results obtained, when it is a matter of moulding cavities, and hence cores, of a particularly complex shape.

BRIEF SUMMARY OF THE INVENTION

One purpose of the present invention is to provide an improvement that renders more homogeneous results obtained and provides benefits.

According to the present invention, said purpose is achieved by a method having the characteristics referred to specifically in the claims that follow. The invention also relates to the corresponding apparatus.

In the application to the consolidation of sand cores, in which there is used, as binder, a protein or similar organic binder designed to be dried, the solution according to the invention enables, in the currently preferred embodiment, implementation of the corresponding process of consolidation in a time interval shorter than 120 seconds, preferably shorter than 90 seconds and, in an even more preferred way, shorter than 60 seconds.

BRIEF DESCRIPTION OF THE SEVERAL VIEWS OF THE DRAWING(S)

Figure 2:
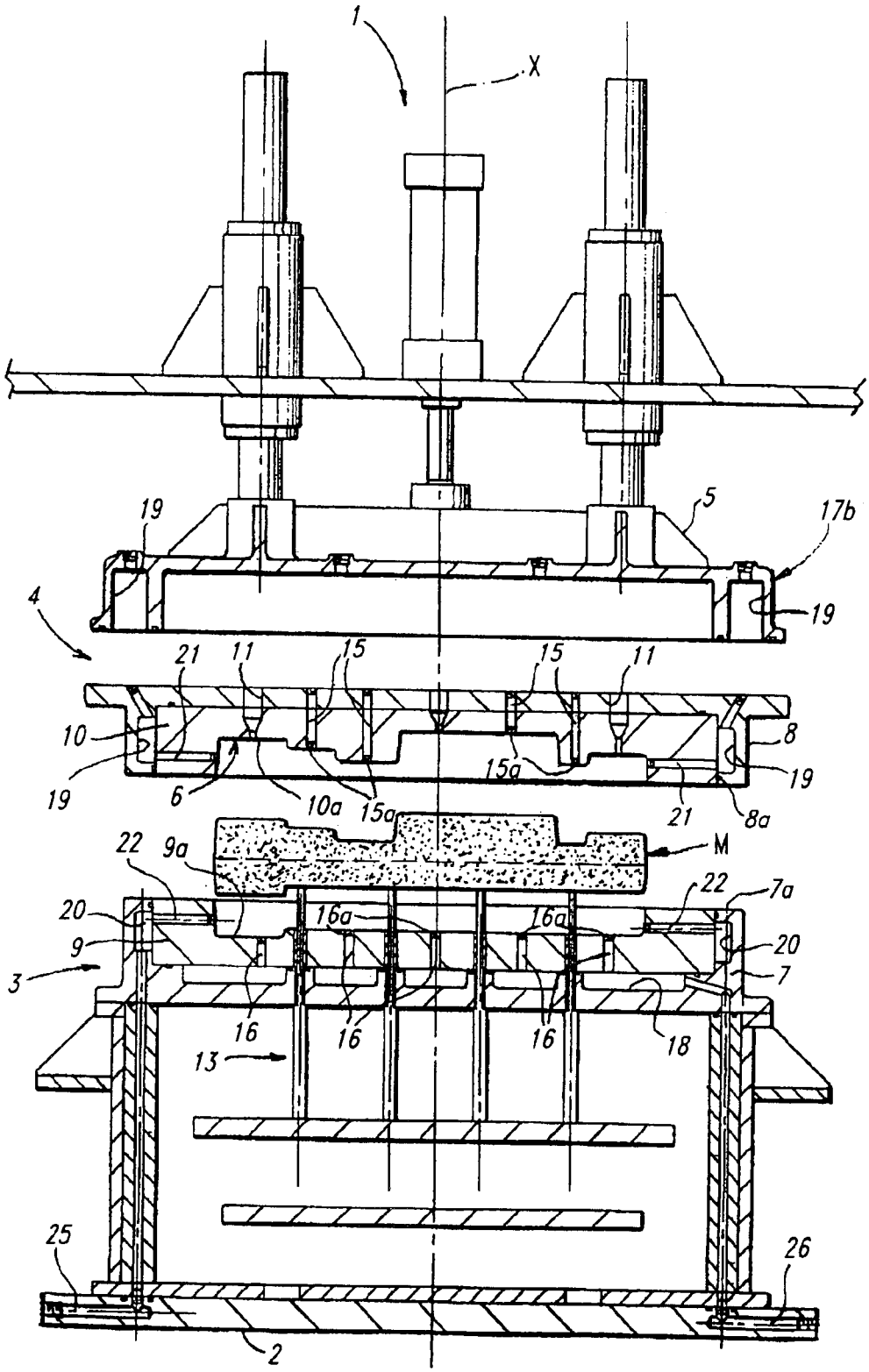

The invention will now be described, purely by way of non-limiting example, with reference to the annexed drawings, wherein:

FIG. 1 is a schematic axial cross section of an apparatus according to the invention with the half-moulds in the closed position; and FIG. 2 is a cross section similar to FIG. 1 illustrating the apparatus with the half-moulds open at the end of the step of preparation of a core.

DETAILED DESCRIPTION OF THE INVENTION

In the annexed drawings, designated as a whole by 1 is an apparatus for the preparation of sand cores for foundry.

This is an apparatus the general overall characteristics and use of which are to be considered certainly known to the prior art and hence such as not to require a detailed description herein.

In the exemplary embodiment illustrated herein, which is purely one example, the apparatus 1 comprises a sturdy framework made of steel structural work 2 in which are mounted, with the possibility of relative movement along an axis X (which, in the present example of embodiment, has a vertical orientation, even though the orientation may, however, be any), two half-moulds 3 and 4.

In the example illustrated herein, the half-mould 3 located in a bottom position is mounted in a position that is fixed with respect to the framework 2.

The half-mould 4, located in a top position, is, instead, carried by a slide 5, which enables its movement in a vertical direction between a lowered position (FIG. 1), in which the two half-moulds 3 and 4 are closed against one another so as to define a moulding cavity designated as a whole by 6, and a raised position (FIG. 2), in which the half-mould 4 is recalled upwards, so as to disengage from the half-mould 3 located in the bottom position.

The mechanisms used for the relative movement of the half-moulds 3 and 4, in particular for control of the movement of the slide 5 on the framework 2 in the direction of the axis X, are to be considered altogether known and hence not such as to require a detailed description herein.

Both of the half-moulds 3 and 4 comprise a shell or outer casing 7, 8 having in general a cup-shaped or tray-shaped conformation so as to present respective inlet or mouth parts 7*a*, 8*a* facing, respectively, upwards (half-mould 3) and downwards (half-mould 4), the aforesaid mouth parts moving into a condition of frontal mating against one another when the half-mould 4 is in the lowered position on the half-mould 3.

Inside the shells or casings 7, 8, there are shaped parts 9, 10 (commonly referred to as "inserts"), which present respective mould surfaces 9*a*, 10*a* shaped so as to define jointly the moulding cavity 6, in which there is to be formed a sand core for foundry, designated as a whole by M.

For this purpose, in one or both of the half-moulds (usually in the half-mould 4 located in the top position) there are provided one or more nozzles 11, through which into the moulding cavity 6 defined by the inserts 9, 10 can be blown a flow of aeriform, which conveys a mass of sand that is to fill the moulding cavity so as to form therein a compact mass of sand designed to assume an external conformation exactly corresponding (in a complementary way) to that of the moulding cavity, so as to give rise to a core usable for foundry uses.

For the aforesaid mass of sand to be used effectively as a core, it must be adequately compacted.

As has already been said in the introductory part of the present description, this result may be achieved by causing the sand that is to be blown into the mould cavity through the nozzles 11 to be mixed to a protein mixed with water.

By adopting the above technique, the subsequent consolidation of the sand core is obtained by causing the water contained in the protein to evaporate, so that the protein itself functions as binder, connecting to one another the grains of sand and imparting the necessary consistency on the core M.

The above technique is to be considered in itself known to the art, as this is documented, for example, by EP-A-0 608 926, already cited previously, and by U.S. Pat. No. 5,837, 373, or U.S. Pat. No. 5,582,231.

The reference number 13 designates an assembly of extractor elements, for example connected to one another according to a general comb-like configuration, which extend through the bottom half-mould 3 and may be selectively lifted upwards (by a motor-powered unit of a known type, not explicitly illustrated in the annexed drawings) so as to be able to bring about the expulsion of the sand core M formed in the mould cavity 6 once this has been consolidated. The foregoing, of course, is obtained after prior raising of the half-mould 4 which is in the top position (see FIG. 2). The choice illustrated is not, on the other hand, imperative since the assembly of ejector elements 13 may also be positioned in a different way, for example on both of the half-moulds 3, 4 or only on the top half-mould 4.

In order to obtain, through the mould cavity 6, the flow of aeriform, typically heated air, which brings about the dehumidification of the sand/protein/water mixture blown into the mould cavity, in both of the inserts 9 and 10 there are provided ducts for flow of aeriform, which are designated, respectively, by 15 (top half-mould 4) and 16 (bottom half-mould 3).

The aforesaid ducts come under corresponding chambers designated, respectively, by 17 (ducts 15 and top half-mould 4) and 18 (ducts 16 and bottom half-mould 3).

In the embodiment illustrated, purely by way of example, in the figures, the chamber 18 is formed in the shell or outer casing 7 of the bottom half-mould 3, whilst the chamber 17 is formed in a gassing plate 17*b*, connected in a stable way or, preferably, in a removable way to the shell or outer casing 8 of the half-mould 4.

In particular, by supplying aeriform (typically hot air) under pressure to the chamber 17, it is possible to establish through the ducts 15 a flow of aeriform (directed from the top downwards), which penetrates into the mould cavity and traverses the sand core that is being consolidated and then exits from the moulding cavity through the ducts 16 and flows out of the machine through the chamber 18.

The reference numbers 15*a* and 16*a* designate wire gauzes or filters applied at least in an area corresponding to the end of the ducts 15 and 16, which face the mould cavity. Said wire gauzes or filters 15*a* and 16*a* have dimensions of the mesh such as to prevent the exit of the sand from the mould cavity. Associated to the nozzles 11, through which the mixture of sand, protein and water is injected in the mould cavity, are respective valve means (not illustrated, but of a known type), made so as to prevent the, even partial, outflow of the sand during the step of blowing-in of air. The nozzles 11 can also be provided with wire gauzes/filters for enabling exit of a flow of aeriform.

In a possible embodiment (not specifically illustrated in the annexed drawings), it is also possible to envisage that one or more of the ducts 16 extend through the extractor elements 13 of the ejector assembly.

The fact that the ducts 15 (located in the half-mould 4 in the top position) have been mentioned prior to the channels 16 (located in the bottom half-mould 3) is due to the fact that the flow of aeriform to which reference has been made previously, designed to extend along the axis X and hence along the direction of approach/recession of the half-moulds 3, 4, is preferably controlled from the top downwards.

Of course, it is possible to resort, also at subsequent stages of the process of drying/consolidation of the sand core, to a reversal of the aforesaid flow, by causing the aforesaid flow of aeriform to enter the mould cavity through the ducts 16 and then to exit from the same mould cavity through the ducts 15.

Once again, it will be appreciated that the aforesaid flow of aeriform (whatever its direction, whether from the top downwards or from the bottom upwards) may be controlled both as a result of the pressurization of one of the chambers 17, 18 and by de-pressurization (as a result of the connection to a suction element or, in general, to a source of subatmospheric pressure) of one of said chambers. Again, it is possible to exploit in a combined way both the pressurization of one of the chambers and the depressurization of the other chamber.

One preferred characteristic of the solution according to the invention is provided by the fact that, in addition to the chambers 17 and 18 (and to the ducts 15, 16), which are designed to ensure a flow of aeriform oriented principally along the axis X, there are present, in a position as a whole peripheral with respect to the inserts 9, 10, further chambers, designated by the reference numbers 19 (top half-mould 4) and 20 (bottom half-mould 3).

In a preferred way, the aforesaid chambers 19, 20 have an annular development, in the sense that they extend in a continuous way or with possible discontinuities along the boundary or at least along part of the boundary of the half-mould cavities 9*a*, 10*a* defined by the inserts 9 and 10.

Starting from the chambers designated by 19 and 20, there branch off further sets of ducts 21, 22 formed inside the inserts 9, 10, which give out inside the mould cavity according to modalities substantially similar to the ones described for the ducts 15 and 16. Consequently, also the ducts 21, 22 are provided, in an area corresponding to their end facing the mould cavity, with respective gauzes/filters 21*a*, 22*a*, designed to arrest the undesirable movement of exit of the sand from the mould cavity.

By applying also to the chambers 19 and 20 a mechanism of pressurization/depressurization similar to the one previously described with reference to the chambers 17 and 18, it is possible to establish, through the mould cavity, flows of aeriform substantially similar to the flow of aeriform which occurs along the axis X described previously.

However, the aforesaid flows of aeriform present the important characteristic of being generically oriented, at least in part, in a "radial" direction with respect to the direction of the axis X.

The term "radial" is understood herein and the claims to indicate any direction of flow of aeriform generically oriented in a direction transverse with respect to the axis X.

By "radial flow", for the purposes of the present invention, there is hence understood also a flow which, albeit not directed exactly and totally in a direction orthogonal with respect to the axis X (which, it is recalled, may be oriented in any direction in space), presents in any case a non-negligible component oriented in a direction orthogonal to the axis X.

In particular, in a particularly preferred embodiment of the invention, it is envisaged that each of the chambers 17, 18, 19 and 20 will have associated thereto respective valve assemblies (schematically indicated in FIG. 1 and designated by the same reference numbers of the respective cavities, followed by the letter a), which enable selective connection of each of the aforesaid chambers both to a supply line (typically represented by a source of de-humidified aeriform, such as air, possibly heated air) designated by 23 and to a discharge line designated by 24.

As has already been said, the above result may be obtained both by connecting the line 23 to a pumping element or else to a source of superatmospheric and leaving the discharge line 24 at atmospheric pressure and by causing the line 23 to be at atmospheric pressure, whilst the line 24 is connected to a suction element or to a source of subatmospheric pressure, or else by combining both of the solutions, i.e., by connecting the line 23 to a source of superatmospheric pressure and the line 24 to a source of subatmospheric pressure.

A control unit, typically represented by a processing unit, such as a so-called PLC or an equivalent device (not illustrated), supervises the general operation of the apparatus 1 and, in particular, is able to control operation of the distribution devices designated by 17*a*, 18*a*, 19*a* and 20*a* so as to be able to provide, selectively, any one of the admissible configurations of flow between the chambers 17, 18, 19 and 20.

By "admissible configuration" is of course meant any combination such as to enable regular inflow and outflow of the aeriform into/out of the mould cavity.

The solution according to the invention enables, for example, combination of a main flow along the axis X (from the channels 15 to the channels 16, or vice versa), i.e., flows that are, so to speak, angled, for example flows which enter the cavity through the ducts 15 and/or 16 and then flow out of the cavity through the ducts 21 and/or 22.

In a possible variant embodiment (not illustrated) it is then possible to "partialize"—for example by means of diaphragms—the chambers 19 and 20, giving rise to corresponding subchambers located on opposite sides of the mould cavity 6, with associated thereto corresponding valve assemblies/distribution elements. In this way, it is possible to generate one or more radial flows, for example in which the (sub)chambers located "on the right" of the mould cavity function as pumping cavities whilst the homologous (sub) chambers located "on the left" function as outflow cavities, or vice versa.

The supply of the chambers 18, 19, 20 and 21 may occur by means of ducts, which extend practically throughout the body of the respective half-moulds.

Alternatively, the said ducts can be obtained only in part in said half-moulds, whilst other parts extend, for example, in the machine bed, as is the case of the ducts designated by 25 and 26 in the bottom part of the figures.

The latter solution proves particularly advantageous in the case where, as in a possible embodiment of the invention, the apparatus 1 is obtained in the form of a number of stations, in which the half-moulds 3 and 4 are mounted on a carousel structure so as to be able to be selectively and alternatively moved between a position for blowing-in of the mixture of sand into the mould cavity and a position of treatment of the mass of sand aimed at the consolidation thereof. For example, in a machine of this type, it is possible to cause the two half-moulds, into which a mass of sand has been blown, which is to be consolidated, to be translated towards the consolidation station whilst two other half-moulds are made to advance towards the blowing-in position.

In this way, it is possible to perform in parallel, in the context of a single machine with a number of stations, the two operations of blowing-in of the mass of sand and of consolidation thereof, with achievement of a considerable advantage in terms of efficiency of production.

The above advantage is particularly appreciated in the case of the solution according to the invention, which enables a reduction in the consolidation time of the sand/hydrated protein mixture to an interval of time shorter than 120 seconds, preferably shorter than 90 seconds and, in an even more preferred way, shorter than 60 seconds.

Of course, without prejudice to the principle of the invention, the details of implementation and the embodiments may vary widely with respect to what is described and illustrated herein, without thereby departing from the scope of the present invention.

This applies, in particular, as regards the possibility of resorting to yet another solution of embodiment with the aim of generating through the mould cavity—and the mass of sand which is inside it—a flow of aeriform directed at least in part in a radial direction with respect to the principal direction represented by the axis X in the annexed drawings.

The above further solution in one embodiment included within the scope of the present invention envisages "partialization," for example via intermediate diaphragms of one or both of the chambers designated by 17 and 18 in the annexed drawings. The purpose of the foregoing is to ensure that, of the openings or ducts that come under, on the one hand, the chamber 17 or 18 and, on the other hand, the mould cavity where the mass of sand is located:

a first set (for example comprising openings or ducts located in a central position with respect to the mould cavity) will be used for introducing or blowing in the aeriform into the mould cavity; and another set (for example comprising openings or ducts located in a position that is peripheral with respect to the mould cavity) will be used for sifting or expelling the aeriform from the mould cavity.

If recourse is had to the latter solution, the aeriform enters the mould cavity through the first set of openings (consequently, for example, in a central position) and then exits the cavity through the second set of openings (hence, for example, in a peripheral position).

The foregoing is obtained in such a way that the aforesaid flow of aeriform traverses the inside of the mould cavity according to a path comprising:

a first stretch—of inlet into the mould cavity—substantially oriented in an axial direction, hence according to the axis X, corresponding to blowing-in of the aeriform into the cavity through the aforesaid first set of openings;

a second stretch—of diffusion/propagation through the mould cavity—in which, by deviating gradually with respect to the original axial path, the flow of aeriform is oriented in a radial direction with respect to the mould cavity (i.e., in a direction transverse to the axis X), propagating from the central area towards the periphery of the mould cavity; and a third stretch—of exit from the mould cavity—in which the flow of aeriform deviates from the radial direction to orient itself once again in an axial direction (i.e., along the axis X) so as to be able to exit from the mould cavity through the aforesaid second set of openings, of course in a direction opposite to the direction in which the aeriform was introduced into the mould cavity.

It is, on the other hand, evident that, in the aforesaid second stretch of the path, the flow of aeriform may diffuse/propagate through the mould cavity, instead of in the centrifugal direction, as occurs in the case of the example described previously, in a centripetal direction. The latter result can be obtained, maintaining the general set-up that has just been described, simply by ensuring that the flow of aeriform is blown into the mould cavity in a peripheral position and expelled therefrom in a central position.

It is likewise evident that the latter modalities described for the purpose of generating through the mould cavity—and through the mass of sand which is located therein—a flow of aeriform directed at least in part in a radial direction with respect to the principal direction represented by the axis X in the annexed drawings can be adopted in a combined way with the modality illustrated in the preceding part of the description with specific reference to the annexed drawings.

What is claimed is:

1. A method for producing sand cores for foundry, the method comprising the operations of:

defining a moulding cavity;

introducing a mixture of sand and hydrated binder into said moulding cavity so as to produce a mass of sand, which reproduces in a complementary way the shape of said moulding cavity;

producing a passage through said mass of sand, of a flow of aeriform along at least one principal direction, so as to determine the consolidation of said mass of sand;

generating through said mass of sand a flow of aeriform directed at least in part in a radial direction with respect to said principal direction; and defining at least one duct which outputs into said moulding cavity along a direction parallel to said principal direction and at least one duct which outputs into said moulding cavity along a radial direction with respect to said principal direction.

2. The method according to claim 1, characterized in that it comprises:

defining a plurality of ducts which give out into the aforesaid moulding cavity;

introducing aeriform into said moulding cavity through a first set of said ducts; and extracting the aeriform of said moulding cavity through a second set of said ducts arranged with respect to the first set of said ducts so that said flow of aeriform will traverse said mass of sand along directions having at least one component along said principal direction and at least one component along a radial direction with respect to said principal direction.

3. The method according to claim 1 comprising:

defining a plurality of ducts which give out into said moulding cavity along directions that are parallel to one another; and producing the passage of a flow of aeriform through said ducts which traverses said mass of sand along a path which includes at least one component along a direction orthogonal to the direction of said ducts.

4. The method according to claim 1, characterized in that said flow of aeriform comprises aeriform, such as air, that is heated and/or de-humidified.

5. The method according to claim 1, characterized in that said step of passage of aeriform through said mass of sand has a duration shorter than 120 seconds.

6. The method according to claim 1, characterized in that said step of passage of aeriform through said mass of sand has a duration shorter than 90 seconds.

7. The method according to claim 1, characterized in that said step of passage of aeriform through said mass of sand has a duration shorter than 60 seconds.

8. An apparatus for producing sand cores for foundry, comprising:

a pair of half-moulds, adapted for movement with respect to one another along a principal direction between an open position and a closed position, in which the half-moulds in the closed position define a moulding cavity, means for introducing into the aforesaid moulding cavity a mixture of sand and binder, a plurality of channels, which extend through the aforesaid half-moulds and give out into the aforesaid moulding cavity, means for generating a flow of aeriform through said channels and through said moulding cavity, wherein the aforesaid channels are arranged so as to produce the passage of said flow of aeriform through said moulding cavity along directions having at least one component parallel to said principal direction and at least one radial component with respect to said principal direction; and characterized in that at least one of said half-moulds comprises at least one channel, which gives out into the aforesaid moulding cavity along a direction parallel to the aforesaid principal direction, and at least one channel, which gives out into the aforesaid moulding cavity along a radial direction with respect to said principal direction.

9. The apparatus according to claim 8, characterized in that at least one of said half-moulds has a plurality of ducts, which give out into the aforesaid moulding cavity along directions that are parallel to one another, and in that a first part and a second part of said ducts can be connected to respective lines at different pressures, so as to establish a flow of aeriform from said first part of ducts to said second part of ducts, said flow of aeriform traversing said moulding cavity with at least one radial component with respect to said principal direction.

10. The apparatus according to claim 8, characterized in that said ducts are divided into sets connected to respective chambers, each of said chambers being connectable to a respective line at a pressure of aeriform selectively determined.

11. The apparatus according to claim 10, characterized in that each of said chambers is associated to respective valve assemblies, which can be controlled for connecting selectively the respective chamber to at least one between a source of aeriform under pressure and/or a source of negative pressure.

12. The apparatus according to claim 8, characterized in that it comprises a set of extractor elements for expulsion of the core formed by said mass of sand in said moulding cavity, at least one of said extractor elements being provided with a duct communicating with said moulding cavity for supply or extraction of a flow of aeriform.

13. An apparatus for producing sand cores for foundry, comprising:

a pair of half-moulds, adapted for movement with respect to one another along a principal direction between an open position and a closed position, in which the half-moulds in the closed position define a moulding cavity;

means for introducing into the moulding cavity a mixture of sand and binder;

means for generating a flow of aeriform into the moulding cavity;

a plurality of channels, which extend through the half-moulds and output to the moulding cavity, the channels being arranged so as to produce the passage of said flow of aeriform through said moulding cavity along directions having at least one component parallel to the principal direction and at least one radial component with respect to the principal direction;

one of said half-moulds having a first channel that outputs a flow of aeriform into the moulding cavity along a direction parallel to the principal direction, and a second channel that outputs a flow of aeriform into the moulding cavity along a radial direction with respect to said principal direction; and means for changing a direction of the flow of the aeriform from a first direction to a second direction, the direction being reversible.

14. The apparatus of claim 13, further comprising:

a sub-chamber in each of the half-moulds, one sub-chamber on each side of the moulding cavity along the radial direction, the sub-chambers being partitioned one from another; and a plurality of valve assemblies and channels associated with each of the sub-chambers, the valves and channels being capable of effecting a radial flow of aeriform between the sub-chambers.

15. The apparatus of claim 13 further comprising:

a first path for the flow of aeriform into the moulding cavity, the flow of aeriform entering the moulding cavity from a first channel substantially oriented in the principal direction; and a second path for the flow of aeriform through the moulding cavity, the second path gradually deviating from the principal direction and being gradually oriented in the radial direction, the flow of aeriform being directed towards sides of the moulding cavity along the radial direction; and a third path for the flow of aeriform through the moulding cavity, the third path gradually deviating from the radial direction and being gradually oriented in the principal direction and exiting the moulding cavity through a second set of channels, the second set of channels being located on the opposite side of the moulding cavity with respect to the first set of channels along the principal direction.

16. An apparatus for producing sand cores for foundry, comprising:

a pair of half-moulds, adapted for movement with respect to one another along a principal direction between an open position and a closed position, in which the half-moulds in the closed position define a moulding cavity;

means for introducing into the moulding cavity a mixture of sand and binder;

means for generating a flow of aeriform into the moulding cavity;

a plurality of channels, which extend through the half-moulds and output to the moulding cavity, the channels being arranged so as to produce the passage of said flow of aeriform through said moulding cavity along directions having at least one component parallel to the principal direction and at least one radial component with respect to the principal direction;

one of said half-moulds having a first channel that outputs a flow of aeriform into the moulding cavity along a direction parallel to the principal direction, and a second channel that outputs a flow of aeriform into the moulding cavity along a radial direction with respect to said principal direction; and each of the half-moulds having a plurality of input channels, the plurality of input channels supplying the flow of aeriform into the moulding cavity, and a plurality of output channels, the plurality of output channels exhausting the flow of aeriform from the moulding cavity.

17. The apparatus of claim 16 wherein the aeriform is dehumidified and hot air.

18. The apparatus of claim 16 further comprising:

a first path for the flow of aeriform into the moulding cavity, the flow of aeriform entering the moulding cavity from a first channel substantially oriented in the principal direction; and a second path for the flow of aeriform through the moulding cavity, the second path gradually deviating from the principal direction and being gradually oriented in the radial direction, the flow of aeriform being directed towards sides of the moulding cavity along the radial direction; and a third path for the flow of aeriform through the moulding cavity, the third path gradually deviating from the radial direction and being gradually oriented in the principal direction and exiting the moulding cavity through a second set of channels, the second set of channels being located on the opposite side of the moulding cavity with respect to the first set of channels along the principal direction.

* * * * *